United States Patent [19]

Ura et al.

[11] Patent Number: 4,526,358

[45] Date of Patent: Jul. 2, 1985

[54] PAPER FEEDING MECHANISM

[75] Inventors: Hiroaki Ura; Shogo Kato, both of Tokyo, Japan

[73] Assignee: Konishiroku Photo Industry Co., Ltd., Tokyo, Japan

[21] Appl. No.: 383,743

[22] Filed: Jun. 1, 1982

[30] Foreign Application Priority Data

Jun. 9, 1981 [JP] Japan ..... 56-88472
Jun. 9, 1981 [JP] Japan ..... 56-88473
Jun. 9, 1981 [JP] Japan ..... 56-88474

[51] Int. Cl.[3] ..... B65H 3/04

[52] U.S. Cl. ..... 271/34; 271/122; 271/124; 271/125

[58] Field of Search ..... 271/34, 35, 124, 125, 271/121, 122, 127, 164, 162, DIG. 3

[56] References Cited

U.S. PATENT DOCUMENTS 1,637,833 8/1927 Mueller ..... 271/124
3,957,366 5/1976 Taylor ..... 271/34
4,060,233 11/1977 Stange ..... 271/34
4,312,503 1/1982 Saxinger ..... 271/34

*Primary Examiner*—Bruce H. Stoner, Jr.
*Assistant Examiner*—John A. Carroll
*Attorney, Agent, or Firm*—James E. Nilles

[57] ABSTRACT

The invention relates to a mechanism whereby individual sheets are fed from a cassette that carries a pile of paper sheets. The mechanism comprises a paper feed member which is mounted over the front portion of a feed bed whereon a cassette is removably installed and which is movable orbitally to feed sheets forward, and a retarding member engaged under upward bias against the feed member to prevent forward feed of sheets below one that is directly engaged with the feed member. The retarding member is so arranged as to be in its operative position when a cassette is fully installed on the feed bed but to move rearwardly and away from the feed member as the cassette is rearwardly removed from the feed bed, to thus release unfed but jammed sheets for removal with the cassette.

7 Claims, 10 Drawing Figures

PAPER FEEDING MECHANISM

BACKGROUND OF THE INVENTION

1. Field of the Invention

The present invention relates to a paper feeding mechanism to be used with an electrophotographic copying apparatus or the like and, more particularly, to a paper feeding mechanism which includes a paper feed member for conveying copy paper and a retarding member adapted to be brought into abutting contact with the paper feed member.

2. Description of the Prior Art

In electrophotographic copying apparatus or the like, as is well known in the art, there has been used especially as a high speed paper feeding device a paper feeding mechanism of the type in which a paper feed member such as a paper feed roller is positioned in the vicinity of a paper feed bed on which is mounted a copy paper cassette that carries copy paper, and in which a retarding member is adapted to be brought into abutting contact with the surface of that paper feed member. In a paper feeding mechanism of this type, more specifically, plural sheets of copy paper are lifted off from the copy paper cassette by the paper feeding motions of the paper feed member, but only the uppermost sheet of the copy paper is fed past the retarding member, which holds back the sheets that are below the topmost one. According to the construction thus far described, however, plural sheets of copy paper are held jammed between the paper feed member and the retarding member even when the paper feeding mechanism is feeding no copy paper. As a result, in case the copy paper cassette is to be removed out of the paper feed bed, there is a tendency for the jammed copy paper to be left in the paper feeding mechanism. Upon replacement or the like of the copy paper cassette, therefore, there arises the inconvenience that each of the sheets left on the paper feed bed has to be manually cleared.

SUMMARY OF THE INVENTION

It is therefore an object of the present invention to provide a mechanism for feeding sheets of copy paper one at a time out of a copy paper cassette that is removably supported on a paper feed member, said mechanism being of the type comprising a paper feed bed and a retarding member that is normally engaged under upward bias against the paper feed member, said mechanism being so arranged that the retarding member is spaced from the paper feed member whenever the paper feed bed does not have a copy paper cassette fully loaded onto it, so that sheets jammed between the paper feed member and the retarding member are released for removal with a copy paper cassette that is being taken off of the paper feed bed, and said mechanism being further so arranged that the retarding member is brought back into operative engagement with the paper feed member by proper loading of a copy paper cassette onto the paper feed bed.

Thus it is also an object of the present invention to provide a paper feeding mechanism of the character described wherein, when a copy paper cassette is being removed from the paper feed bed, all of the unfed sheets from that cassette that had been jammed between the paper feed member and the retarding member are automatically released from between those members for removal with that cassette.

Other objects and features of the present invention will be made apparent from the following description taken in conjunction with the accompanying drawings.

DESCRIPTION OF THE PREFERRED EMBODIMENTS

Figure 1:
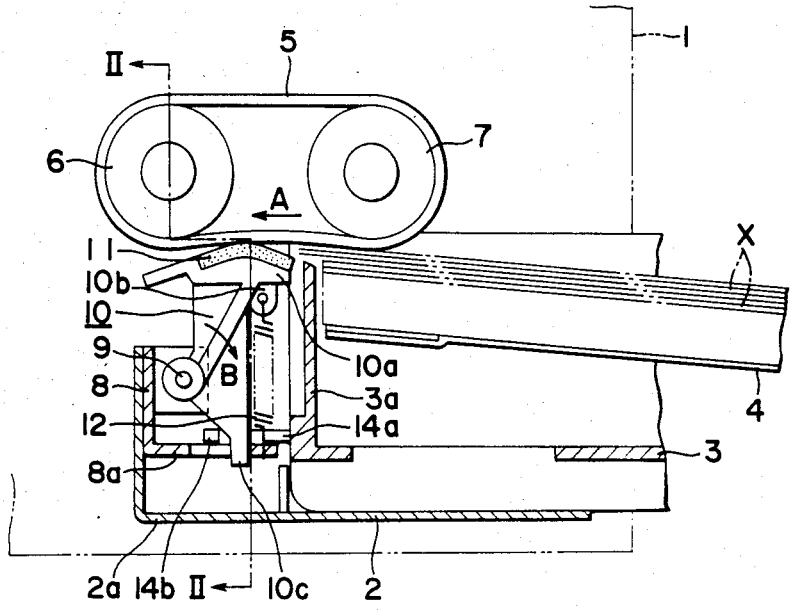
FIG. 1 is a sectional view showing a paper feeding mechanism according to the first embodiment of the present invention.
Figure 2:
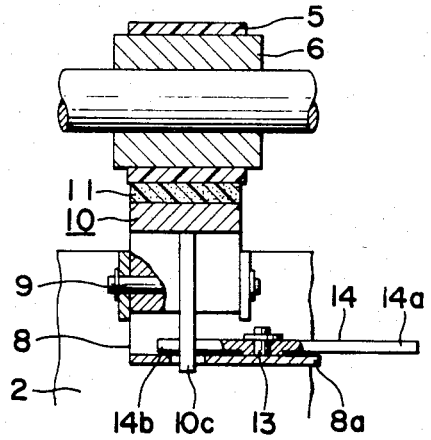
FIG. 2 is a sectional view taken along line II—II of FIG. 1.
Figure 3:
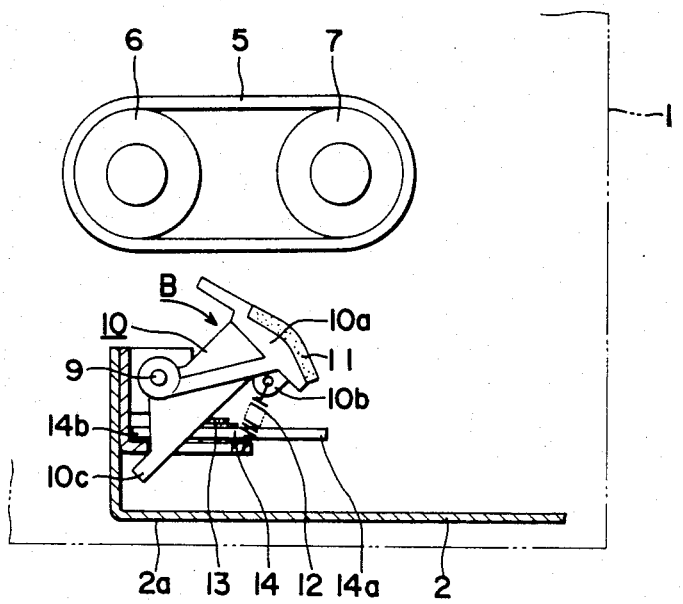
FIG. 3 is an explanatory view illustrating the operations of the same paper feeding mechanism.

FIGS. 1 to 3 show a first embodiment of the present invention, in which a paper feed bed 2 of an electrophotographic copying apparatus generally indicated at reference numeral 1 is loaded with a copy paper cassette 3 carrying plural sheets of copy paper X. The copy paper cassette 3 is equipped with a bottom plate 4 for supporting the plural sheets of copy paper X thereon in a piled state. That bottom plate 4 is so constructed that it may be lifted, as shown in FIG. 1, by the action of a not-shown lifting member when the cassette 3 is completely loaded onto the paper feed bed 2.

Above the inner end portion 2*a* of the aforementioned paper feed bed 2, there is disposed a paper feed member which is exemplified by an endless belt 5. Specifically, this belt 5 is made to run on drive and driven pulleys 6 and 7, which are juxtaposed in a horizontal direction to each other, so that it is driven by the pulleys 6 and 7 in the direction of arrow A.

To the inner end portion 2*a* of the aforementioned paper feed bed 2, moreover, there is fixed a mounting plate 8 having a pivot pin 9, on which a retarding member 10 is supported in a rocking manner. To the head 10*a* of that retarding member 10, there is fixed a friction member 11 which is made of a material having a high friction resistance. This friction member 11 is adapted to be brought into abutting contact with the surface of the endless belt 5, as will be described hereinafter. Between the aforementioned mounting plate 8 and the ear 10*b* of the peeling member 10, there is interposed a tension spring 12, by which the peeling member 10 is biased in the direction of arrow B.

On the bottom wall 8*a* of the mounting plate 8, as shown in FIG. 2, there is anchored a pivot pin 13, on which an actuating member for sensing the presence of the copy paper cassette 3, i.e., an actuating lever 14, is supported. This actuating lever 14 has a follower portion 14*a*, which is so positioned within the moving range of the copy paper cassette 3 that it can be engaged by the front wall 3*a* of the same cassette, and it has an actuating portion 14*b* which is so positioned in the vicinity of the engaging portion 10*c* of the aforementioned retarding member 10 as to bring the friction member 11 into abutting contact with the surface of the endless belt 5 when the follower portion 14*a* is advanced by the front wall 3*a* of the copy paper cassette 3.

Since the paper feeding mechanism according to the foregoing embodiment has the construction thus far described, the retarding member 10 is rocked by the force of the tension spring 12, as shown in FIG. 3, in case the paper feed bed 2 not loaded with a copy paper cassette 3, so that it is spaced from the endless belt 5. As a result, when the copy paper cassette 3 is introduced onto the paper feed bed 2, the actuating lever 14 is turned on the pivot pin 13 by the front wall 3*a* of the same cassette 3 so that the retarding member 10 is rocked to the position shown in FIG. 1 by the actuation portion 14*b* of the actuating lever 14 until the friction member 11 comes into abutting contact with the surface of the endless belt 5. By the drive of this endless belt 5, therefore, plural sheets of copy paper X are partway lifted from the copy paper cassette 3 but only the uppermost sheet of copy paper X is fed out, the rest being held back by the retarding member 10.

As the copy paper cassette 3 is removed from the paper feed bed 2, moreover, the retarding member 10 is rocked by the force of the tension spring 12 in accordance with the withdrawal of the copy paper cassette 3, thereby to separate the friction member 11 from the endless belt 5 so that the copy paper clamped inbetween is discharged along with its cassette 3 to the outside of the copying apparatus.

Figure 4:
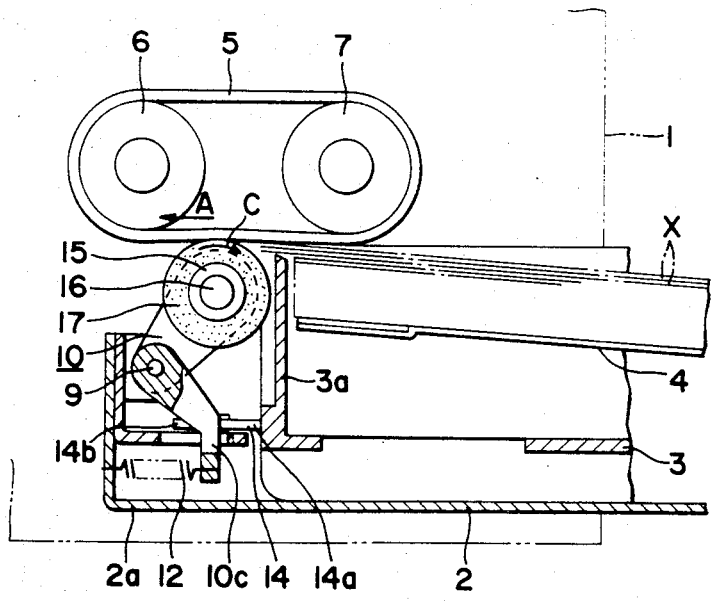
FIG. 4 is a sectional view showing a paper feeding mechanism according to a second embodiment of the present invention.

FIG. 4 shows a paper feeding mechanism according to a second embodiment of the present invention, in which like constructional parts similar to those of the first embodiment shown in FIGS. 1 to 3 are indicated at like reference characters. The feature of the embodiment of FIG. 4 resides in the point that the aforementioned friction member 11 is replaced by a friction roller 17 which is supported on a center shaft 16 of the retarding member 10 through a one-way clutch 15. With this construction, specifically, the friction roller 17 can be readily rotated in the direction of arrow C so that the copy paper clamped between the friction roller 17 and the endless belt 5 can be discharged without any resistance when the copy paper cassette 3 is removed from the paper feed bed 2.

As has already been apparent from the description thus far made, according to the foregoing embodiment of the present invention, the retarding member is brought into abutting contact with the paper feed member in response to the introduction and extraction of the copy paper cassette so that all the sheets of copy paper can be recovered without fail. Moreover, the paper feeding mechanism of the present invention can enjoy the excellent advantages that its production cost is low and that it has few troubles because its construction is simple.

Figure 5:
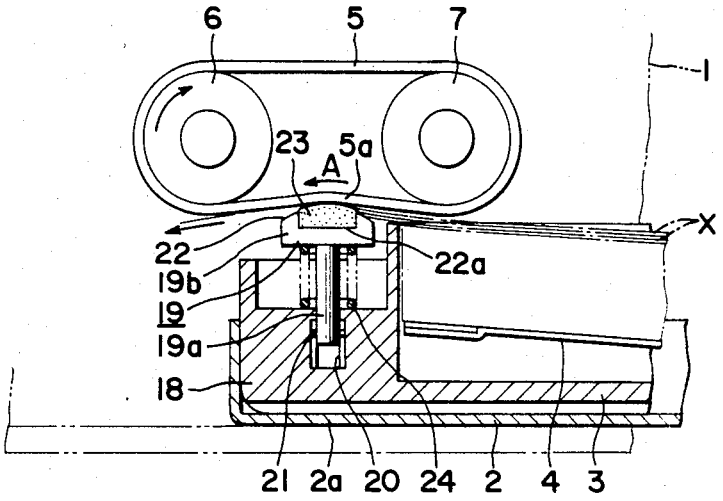
FIG. 5 is a sectional view showing a paper feeding mechanism according to a third embodiment of the present invention.
Figure 7:
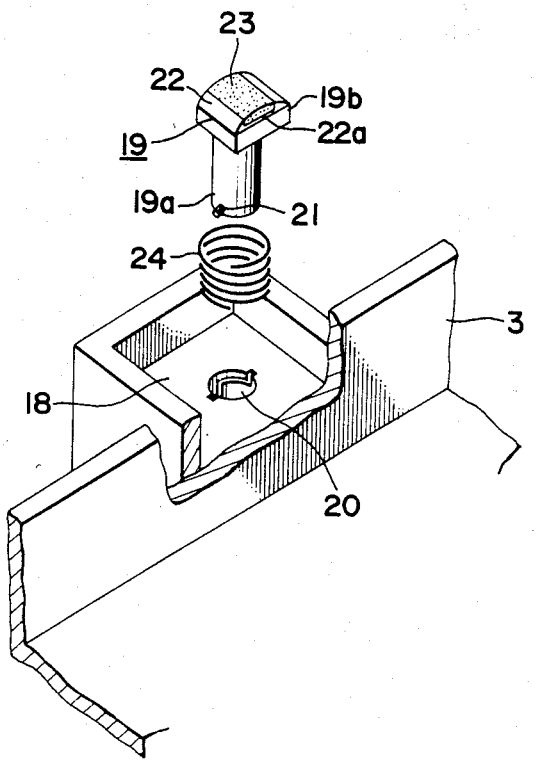
FIG. 7 is an exploded perspective view showing an essential portion of a copy paper cassette.

FIG. 5 shows a third embodiment of the present invention, in which the aforementioned copy paper cassette 3 is formed at its front portion, i.e., at its portion close to the inner end portion 2*a* of the paper feed bed 2 with a mounting bed 18 supporting thereon a retarding member 19 in a manner to be extendable and retractable. This retarding member 19 is constructed, as better seen from FIG. 7, to include a stem 19*a*, which is made slidable in the hole 20 of the mounting bed 18 but is blocked from coming out of the hole 20 by the action of a stopper 21 projected radially of that stem 19*a*. The retarding member 19 further includes a head 19*b* having an arcuate sliding surface 22, and a friction member 23 made of a material having a high friction resistance is embedded in a groove 22*a* which is formed in that head 19*b*. On the stem 19*a* of the aforementioned retarding member 19, there is mounted a compression spring 24 which has its one end seated upon the aforementioned mounting bed 18. As a result, the aforementioned retarding member 19 is biased to protrude by the force of the compression spring 24 thereby to bring its sliding surface 22 into abutting contact with the middle portion 5*a* of the endless belt 5 at all times.

Since the paper feeding mechanism according to the aforementioned embodiment has the construction thus far described, the retarding member 19 is brought into abutting contact with the middle portion 5*a* of the endless belt 5 by the force of the compression spring 24 when the paper feed bed 2 is loaded with the copy paper cassette 3. As a result, the sheets of copy paper X in their cassette 3 are partway lifted off in the direction of the arrow A by the movement of the endless belt 5 in the direction A but the retarding member 19 allows only the uppermost sheet of copy paper X to be fed.

Figure 6:
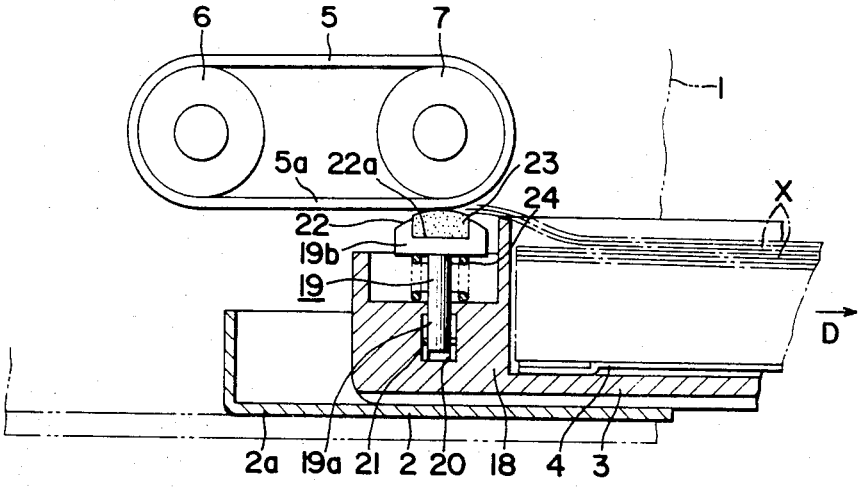
FIG. 6 is an explanatory view illustrating the operations of the same paper feeding mechanism.

When the copy paper cassette 3 is withdrawn from the paper feed bed 2 in the direction of arrow D of FIG. 6, the retarding member 19 moves, while being held in abutting contact with the surface of the endless belt 5, so that the copy paper X clamped between the endless belt 5 and the retarding member 19 moves along with its cassette 3. This keeps the paper feeding mechanism clear of any of the copy paper X when the copy paper cassette 3 is extracted.

As has already been apparent from the description thus far made, according to the present invention, no copy paper is left in the paper feeding mechanism when the copy paper cassette 3 is removed from the paper feed bed 2. In addition, since the friction member 23, which is liable to be heavily worn, is attached to each copy paper cassette 3, the frequency of its replacement is reduced, and the replacement itself can be conducted outside of the paper feeding mechanism, thus making it possible to enjoy an advantage that the replacing work is simplified.

Figure 8:
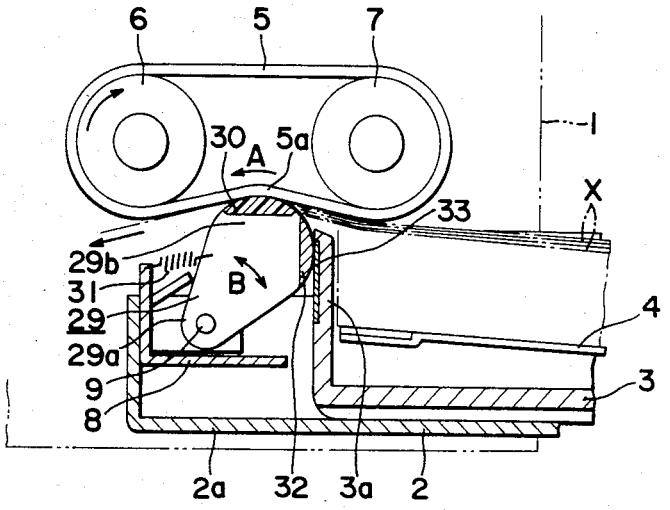
FIG. 8 is a sectional view showing a paper feeding mechanism according to a fourth embodiment of the present invention.
Figure 9:
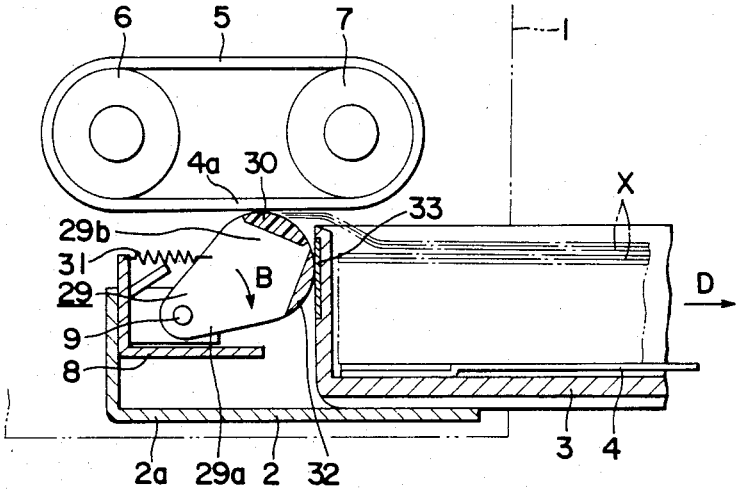
FIG. 9 is an explanatory view illustrating the operations of the same paper feeding mechanism.

FIGS. 8 and 9 show a fourth embodiment of the present invention, in which a reduced end 29*a* of a retarding member 29 having an egg-shaped section is supported in a rocking manner on the pivot pin 9 of the mounting plate 8. To the other or enlarged end 29*b* of the aforementioned retarding member 29, there is fixed a friction member 30 which is made of a material having a high friction resistance and which is adapted to come into abutting contact with the midway portion 5*a* of the endless belt 5. Between the retarding member 29 and the mounting plate 8, moreover, there is mounted a tension spring 31, by which the aforementioned friction member 30 is brought into abutting contact with the midway portion 5*a* of the endless belt 5.

According to the present embodiment, on the other hand, a permanent magnet 32 is fixed to that side of the retarding member 29, which is located to face the aforementioned copy paper cassette 3, and an iron member 33 is correspondingly fixed to the front wall 3*a* of the copy paper cassette 3.

Since the present embodiment has the construction thus far described, the sheets of copy paper X are extracted from their cassette 3 by the drive of the endless belt 5 and the uppermost one is fed by the existence of the friction member 30. When the copy paper cassette 3 is extracted from the paper feed bed 2 in the direction of arrow D of FIG. 9, moreover, the retarding member 29 is rocked in the direction of the arrow B against the force of the tension spring 31 by the attraction which is established between the permanent magnet 32 and the iron member 33. As a result, the friction member 30 is separated from the surface of the midway portion 5*a* of the endless belt 5 so that the copy paper X clamped inbetween is released from its restriction and can be extracted together with its cassette 3 to the outside of the copying apparatus. If the copy paper cassette 3 is continuously pulled, incidentally, the force of the tension spring 31 overcomes the attraction of the permanent magnet 32 so that the retarding member 29 restores its position shown in FIG. 8.

Figure 10:
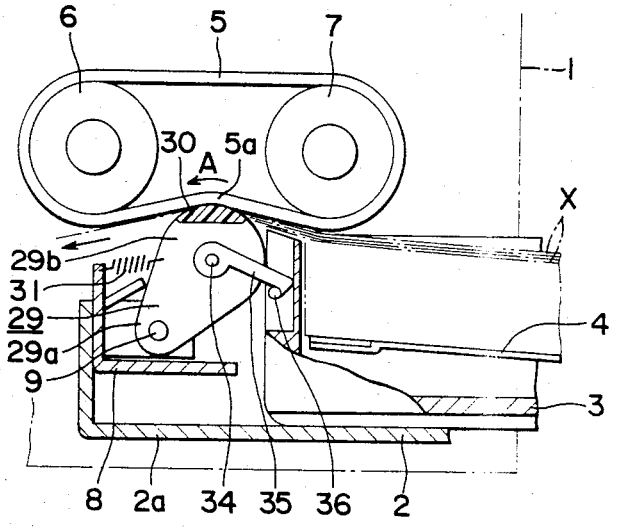
FIG. 10 is similar to FIG. 8 but shows a paper feeding mechanism according to a fifth embodiment of the present invention.

FIG. 10 shows a fifth embodiment of the present invention, in which like constructional parts similar to those of FIG. 8 are indicated at like reference characters. The feature of the embodiment of FIG. 10 resides in a point that the aforementioned combination of the permanent magnet 32 and the iron member 33 is replaced by the combination of a hook 35, which is hinged to the retarding member 29 by means of a pivot pin 34, and a retaining pin 36 which is so anchored at the copy paper cassette 3 that it can engage with the aforementioned hook 35. With the construction thus far described, therefore, the friction member 30 of the retarding member 29 is separated temporarily upon the extraction of the copy paper cassette 3 from the surface of the endless belt 5 so that the operational effect similar to that described with reference to FIG. 9 can be attained.

Here, the present invention should not be limited to the constructions of the embodiments thus far described but can be modified such that a surface fastener is provided between the copy paper cassette 3 and the retarding member 29.

As has already been apparent from the description thus far made, according to the present invention, the retarding member is separated temporarily upon the extraction of the copy paper cassette from the paper feed member so that the copy paper X clamped inbetween is removed to the outside of the copying apparatus while being carried on its cassette. As a result, it is possible to spare the time for removal of the residual copy paper, if any, and to prevent in advance the trouble which is caused by the existence of that residual copy paper.

Since the present invention has a simple construction, moreover, it can enjoy an advantage that its production cost will not be high.

What is claimed is:

1. A paper sheet feeding mechanism comprising a feed base upon which a cassette that carries a plurality of sheets to be fed can be installed by a forward movement, from which the cassette can be removed by a rearward movement, and by which an installed cassette is supported in a predetermined position, an orbitally movable paper feed member mounted above a front portion of said feed base for engaging sheets of paper in an installed cassette to feed them forwardly, and a retarding member beneath said paper feed member and cooperable with it to prevent forward feed of sheets below one that is directly engaged with the paper feed member, said sheet feeding mechanism being characterized by:

A. supporting means on said feed base mounting and guiding said retarding member for movement in a forward and upward direction to an operative position in which the retarding member abuttingly engages the paper feed member and in a downward and rearward direction to a releasing position in which the retarding member is spaced from the paper feed member;

B. spring means reacting between the feed base and the retarding member to bias the latter in one of said directions; and C. actuating means connected with said retarding member and engageable with a cassette installed on said feed base to provide a connection between said cassette and the retarding member whereby the retarding member is moved in the other of said directions by one of said movements of the cassette, said actuating means being arranged to cooperate with the spring means in maintaining the retarding member in its said operative position when a cassette is in its installed position and in actuating the retarding member to its said releasing position upon rearward movement of a cassette out of its installed position.

2. The paper sheet feeding mechanism of claim 1, wherein said spring means biases the retarding member in said rearward and downward direction toward its releasing position, further characterized by:

(1) the retarding member having a rigid abutment portion thereon which swings therewith and which normally projects substantially downwardly from said supporting means; and (2) said actuating means comprising a lever medially pivoted on said feed base and (a) having one arm normally engaging said abutment portion of the retarding member and (b) having an opposite arm abuttingly engageable by a part of a cassette installed on said feed base, whereby forward movement of that cassette is translated into movement of the retarding member in said forward and upward direction.

3. The paper sheet feeding mechanism of claim 1, wherein said spring means biases the retarding member in said forward and upward direction towards its operative position, further characterized by:

said actuating means comprising cooperating attachment means on a cassette and on the retarding member providing a connection between them whereby rearward movement of the cassette from its installed position moves the retarding member in said rearward and downward direction, said connection being arranged for release when the retarding member reaches said releasing position.

4. The paper feed mechanism of claim 3 wherein said attachment means comprises a magnetized element and a magnetically permeable element, one of said elements being on the retarding member and the other of said elements being on a front portion of the cassette.

5. The paper feed mechanism of claim 3 wherein said supporting means comprises a pivot and said attachment means comprises:

(1) a hook pivoted to the retarding member to swing up and down about an axis spaced above the axis of said pivot, and (2) a retaining pin secured to the cassette at a front portion thereof for engagement by said hook.

6. A paper sheet feeding mechanism comprising a feed base upon which a cassette that carries a plurality of sheets to be fed can be installed by a forward movement, from which the cassette can be removed by a rearward movement, and by which an installed cassette is supported in a predetermined position, an orbitally movable paper feed member mounted above a first portion of said feed base for engaging sheets of paper in an installed cassette to feed them forwardly, and a retarding member beneath said paper feed member and cooperable with it to prevent forward feed of sheets below one that is directly engaged with the paper feed member, said sheet feeding mechanism being characterized by:

A. a reciprocating member mounted on said feed base and having at one end thereof said retarding member and at the other end thereof an engaging member which can be engaged with a portion of the cassette, whereby said retarding member is maintained in a position to engage with the paper feed member upon the completion of the insertion of a cassette, and B. biasing means at all times urging said reciprocating member in a direction to separate said retarding member from the paper feed member whereby when the cassette is removed the retarding member is separated from the paper feed member by the force of said biasing means.

7. A cassette wherein a plurality of paper sheets to be fed are carried in a pile and which is cooperable with a sheet feeding mechanism that comprises a feed base for supporting the cassette in a predetermined position to which the cassette can be installed by a forward movement and from which it can be removed by a rearward movement, an orbitally movable paper feed member mounted above a front portion of the feed base for engaging sheets of paper in the cassette to feed them forwardly, and a retarding member beneath said paper feed member and cooperable with it to prevent forward feed of sheets below one that is directly engaged with the paper feed member, said cassette being characterized by:

A. said paper cassette having an upwardly opening well in a front portion thereof;

B. said retarding member comprising:

(1) a downwardly projecting stem portion which is lengthwise slideably received in said well so that the retarding member is carried by the cassette and confined to forward and rearward movement with it but is movable up and down relative to it, and (2) an enlarged head on the top of said stem having a frictional top surface; and C. a coiled spring in said well which surrounds said stem and reacts between said head and an upwardly facing surface on the cassette that is at the bottom of said well to be carried by the cassette and to bias the retarding member upwardly for cooperation with the paper feed member when the cassette is in said predetermined position.

* * * * *